US011618131B2

(12) United States Patent
Lang et al.

(10) Patent No.: US 11,618,131 B2
(45) Date of Patent: Apr. 4, 2023

(54) DEVICE AND METHOD FOR CLAMPING WORKPIECES

(71) Applicant: Lang Technik GmbH, Holzmaden (DE)

(72) Inventors: Guenter Lang, Wernau (DE); Philipp Lang, Holzmaden (DE)

(73) Assignee: LANG TECHNIK GMBH, Holzmaden (DE)

( * ) Notice: Subject to any disclaimer, the term of this patent is extended or adjusted under 35 U.S.C. 154(b) by 0 days.

(21) Appl. No.: 17/212,340

(22) Filed: Mar. 25, 2021

(65) Prior Publication Data

US 2021/0299819 A1 Sep. 30, 2021

(30) Foreign Application Priority Data

Mar. 26, 2020 (DE) ..... 10 2020 108 332.7

(51) Int. Cl.
*B25B 5/02* (2006.01)

(52) U.S. Cl.
CPC ..... *B25B 5/02* (2013.01)

(58) Field of Classification Search
CPC ..... B25B 1/2405; B25B 1/2452; B25B 1/241; B25B 3/00; B25B 5/00; B25B 5/02
USPC ..... 29/559; 269/43, 45, 156, 242, 246, 271
See application file for complete search history.

(56) References Cited

U.S. PATENT DOCUMENTS

| | | | | |
|---|---|---|---|---|
| 4,928,938 | A * | 5/1990 | Ross | B25B 1/2452 269/283 |
| 6,530,567 | B1 | 3/2003 | Lang | |
| 9,296,090 | B2 * | 3/2016 | Bronzino | B25B 1/241 |

FOREIGN PATENT DOCUMENTS

| | | | |
|---|---|---|---|
| DE | 202006011245 | U1 | 11/2006 |
| DE | 202006020457 | U1 | 9/2008 |
| DE | 102012000905 | A1 | 7/2013 |
| DE | 102019102167 | B3 | 11/2019 |
| EP | 1071542 | A1 | 1/2001 |
| EP | 2724817 | A1 | 4/2014 |
| EP | 3388197 | A1 | 10/2018 |

OTHER PUBLICATIONS

German Office Action for Application No. 10 2020 108 332.7.
EP Search Report for Application No. 21 16 2666.

* cited by examiner

*Primary Examiner* — Lee D Wilson
*Assistant Examiner* — Alberto Saenz
(74) *Attorney, Agent, or Firm* — Cantor Colburn LLP

(57) ABSTRACT

An embossing device that serves for preparation of a combined form-fit and friction-fit clamping of a workpiece in a respective clamping chuck. The embossing device includes jaws having embossing teeth that are formed on insertion bodies. The insertion bodies include a penetration edge respectively with which they penetrate into the workpiece surface in order to create a depression with defined dimensions. For this a workpiece contact surface is formed on the insertion body, preferably in the proximity to the bar-like projection that stops the penetration process of the bar-like projection as soon as the workpiece contact surface gets in contact with the workpiece surface during the execution of the embossing process. Then the force required for movement of the jaw increases considerably from which a control device generates a switch-off signal for the operation device.

19 Claims, 5 Drawing Sheets

DEVICE AND METHOD FOR CLAMPING WORKPIECES

CROSS REFERENCE TO RELATED APPLICATIONS

This present application claims priority under 35 U.S.C. § 119 to the following German Patent Application No. 10 2020 108 332.7, filed on Mar. 26, 2020, the entire contents of which are incorporated herein by reference thereto.

BACKGROUND

The invention refers to a device and a method for clamping of workpieces, particularly round workpieces and particularly a device and a method for preparing workpieces for clamping.

For machining workpieces in machine tools, particularly for chip removal machining, the workpieces have to be immovably clamped and held in suitable clamping units. Thereby also larger forces applied on the workpiece during machining processes must not result in that the workpiece moves inside the clamping device or releases therefrom. On the other hand, the workpiece shall be accessible as well as possible in order to carry out as many machining processes on the workpiece as possible in one single setting.

EP 1 071 542 B1 proposes a clamping method in which uniformly distanced depressions are provided on the workpiece in a preparing processing step that only serve as coupling elements during clamping with a respective clamping device, but are apart therefrom without function. After this preparing process step the workpieces are held in clamping chucks that comprise abutment surfaces for friction fit holding on its jaws and that have form-fit elements that are complimentary to the depressions of the workpiece for form-fit positioning and for position securing. The workpiece is then clamped in a combined form-fit and friction-fit manner. This clamping method is basically reliable for workpieces with straight clamping surfaces as well as for workpieces with curved clamping surfaces.

A decisive element of the clamping system according to EP 1 071 542 B1 is an embossing station that serves to apply a number of depressions in the workpiece. These depressions have to fit with clamping teeth of clamping vices, between the jaws thereof the workpiece has to be clamped. These depressions need to have a respective size accuracy.

BRIEF SUMMARY

It is the object of the invention to provide a method for preparing a workpiece for clamping with which size-accurate depressions can be created in a wide spectrum of workpieces consisting of different materials.

The inventive method for clamping of workpieces is based on that depressions are provided on workpieces, particularly workpieces with curved clamping surfaces, as e.g. at least in sections cylindrical clamping surfaces, in which projections of the jaws engage during clamping of the workpiece. The depressions are particularly provided in a preparing process on the workpiece during which the workpiece is plastically deformed, e.g. by embossing. For this an embossing device is used that comprises at least one jaw and a counter support, the distance between one another can be adjusted. The jaw comprises at least one seat for at least one insertion body that comprises a projection having an edge facing toward the workpiece. For carrying out an embossing process the distance between the jaw and the counter support is adjusted until the insertion body gets in contact the workpiece at least with one location of the projection. By a further reduction of the distance between the counter support and the jaw the insertion body penetrates with its projection by a desired dimension into the workpiece and in this manner creates a depression at this location. The insertion body forms an embossing tooth, whereby the projection provided on the insertion body and the surface areas adjoining its edge are used as embossing tooth. It has also shown that the insertion body thereby is subject to only minor wear and provides a long lifetime for various materials. Thereby a specifically shaped insertion body having a projection thereon can be used as embossing tooth. The insertion body can be a body that is specifically provided for this purpose or alternatively an indexable cutting insert.

The adjustment of the distance between the jaw and the counter support is carried out preferably in a force-limited and/or travel controlled manner. Thus, a predefined penetration depth of the insertion body in the workpiece is achieved as far as a maximum force is not exceeded. Thus, the depressions created on the workpiece have a desired uniform shape independent from the material characteristics of the workpiece.

The clamping of the workpiece is carried out subsequently in a clamping device, e.g. in the form of clamping vice with two or movable jaws or in form of a clamping chuck with for example three or more jaws that have clamping surfaces with clamping teeth arranged thereon. The clamping teeth fit into the depressions and create a form-fit. The clamping surfaces get in contact with the workpiece adjoining the depressions and clamp it in addition in a friction-fit manner. Thus, a reliable support of the workpiece in the clamping means is achieved with low required space The circumference of the workpiece is mostly freely accessible and can thus be machined, for example in a chip-removing manner.

The inventive embossing device that is provided for creation of plastic deformation on a workpiece comprises at least one first jaw having at least one seat for holding an insertion body. At the seat an insertion body is arranged and fastened thereon. A counter support is provided on a second jaw arranged opposite the insertion body. It can be formed, for example, by a planar or curved contact surface or by one or more insertion bodies against which the workpiece is pressed during the embossing process. In addition, an operation device is provided in order to move at least one of the jaws toward or away from the other jaw.

The embossing device comprises at least one projection forming an embossing tooth. Particularly, the embossing tooth comprises an edge and surface areas adjoining the edge that include a wedge angle between each other. It is preferably between 45° and 90° and has preferably an amount of 60°. The insertion bodies are preferably releasably attached on the respective seat and thus can be exchanged, if required. The insertion body has, for example, a polygonal circumference and preferably comprises a double or multiple rotational symmetry. The insertion bodies can thus be attached on the respective jaw in two or more positions. In doing so, the insertion body can be attached in a different position on the seat after a respective wear occurred in order to be further used as embossing tooth.

The projection of the insertion body can have a bar-like shape and can extend along a side surface of the insertion body. This projection forms an embossing tooth that is configured to create a depression with exactly defined shape on the workpiece.

The bar-like projection is preferably orientated parallel to the workpiece support surface of the jaw. In doing so, a particularly reliable subsequent holding of the workpiece in a clamping chuck that is configured for this purpose is achieved.

The bar-like projection preferably comprises a triangular cross-section. This facilitates the embossing process. Preferably the projection is straight and adjoins a surface at least at one of its two flanks, whereby this surface is configured as workpiece support surface. In doing so, depth and shape of the depression embossed in the workpiece are defined.

In a preferred embodiment the seats provided for holing the insertion bodies are configured as pockets from which the insertion bodies project, if they are arranged therein. Preferably the jaws comprise a workpiece support surface above which the insertion bodies extend. The workpiece is placed on the workpiece support surfaces of each jaw during embossing and the embossing process is initiated and carried out thereafter by reducing the distance between the jaws. Due to this configuration, the axial position of each created depression relative to the face of a cylindrical workpiece is unambiguously defined. The inventive embossing device is thus robust, durable and precise.

Advantageous embodiments of the invention are subject of dependent claims, the drawings, as well as the associated descriptions. The drawings show:

DETAILED DESCRIPTION

Figure 1:
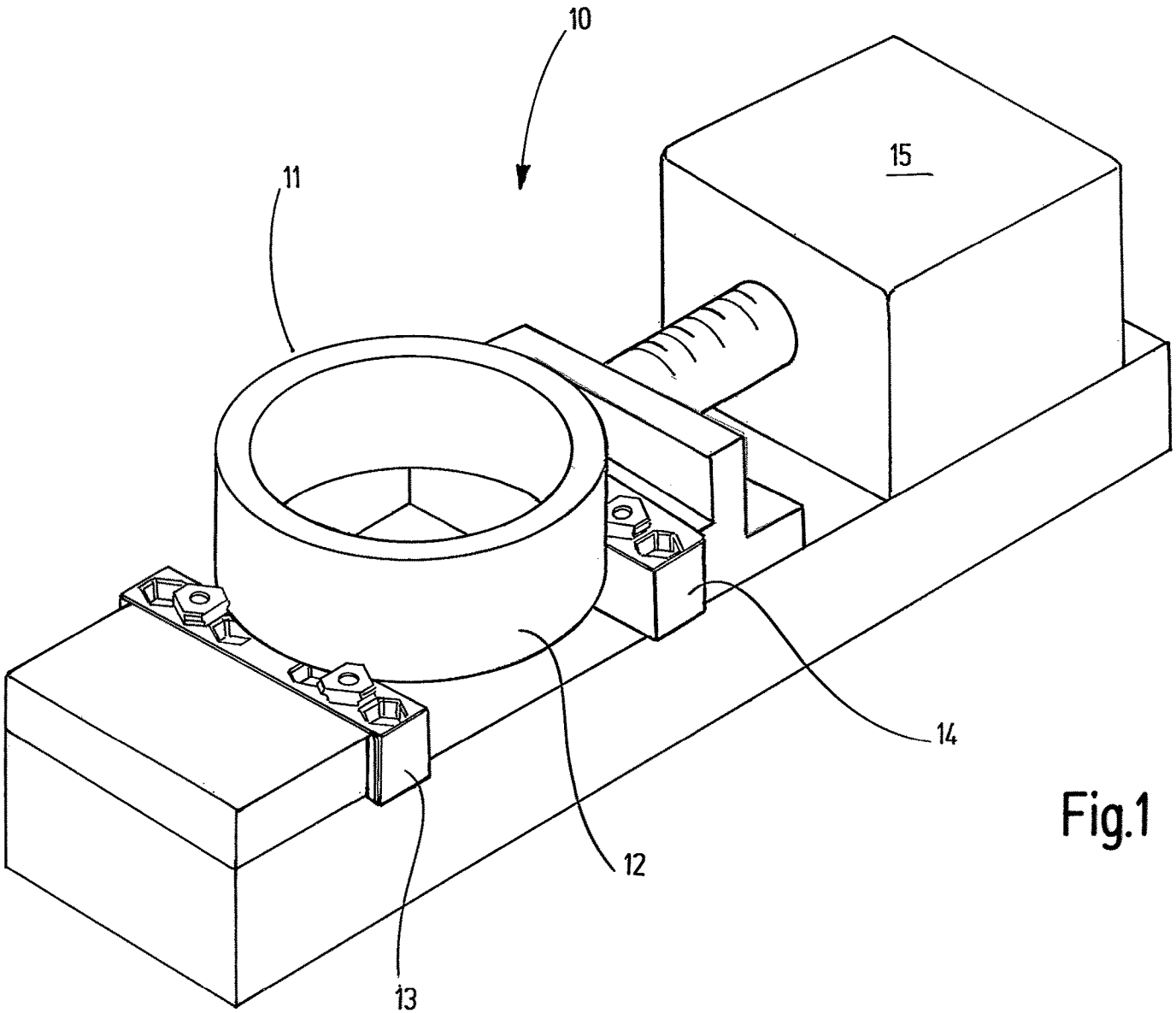
FIG. 1 an embossing station for preparation of a workpiece for clamping in a suitable clamping chuck in a perspective schematic illustration, FIG. 2 the embossing station of FIG. 1 in top view, FIG. 3 the embossing station in a sectional perspective illustration, FIG. 4 an insertion body in top view, FIG. 5 the insertion body according to FIG. 4 in lateral view, FIG. 6 a modified embodiment of an insertion body and a corresponding workpiece in schematic vertically sectioned illustration, FIG. 7 a further modified embodiment of an embossing station in simplified vertically sectioned illustration.

FIG. 1 illustrates an embossing device 10 that serves to prepare a workpiece 11 for clamping in a clamping chuck that is configured for this purpose. The workpiece 11 is symbolized by a ring. However, workpieces 11 can also have different shapes, wherein they only correspond at least in sections to a cylinder in a lower zone 12 of their circumferential surface adjoining the base surface. The workpiece 11 can be subsequently held in a rotating chuck, e.g. in order to carry out lathe machining processes, rotational milling processes or the like.

Two jaws 13, 14 are part of the embossing device 10, wherein the distance of the jaws 13, 14 from each other can be adjusted in a controlled manner by means of an operation device 15.

Figure 2:
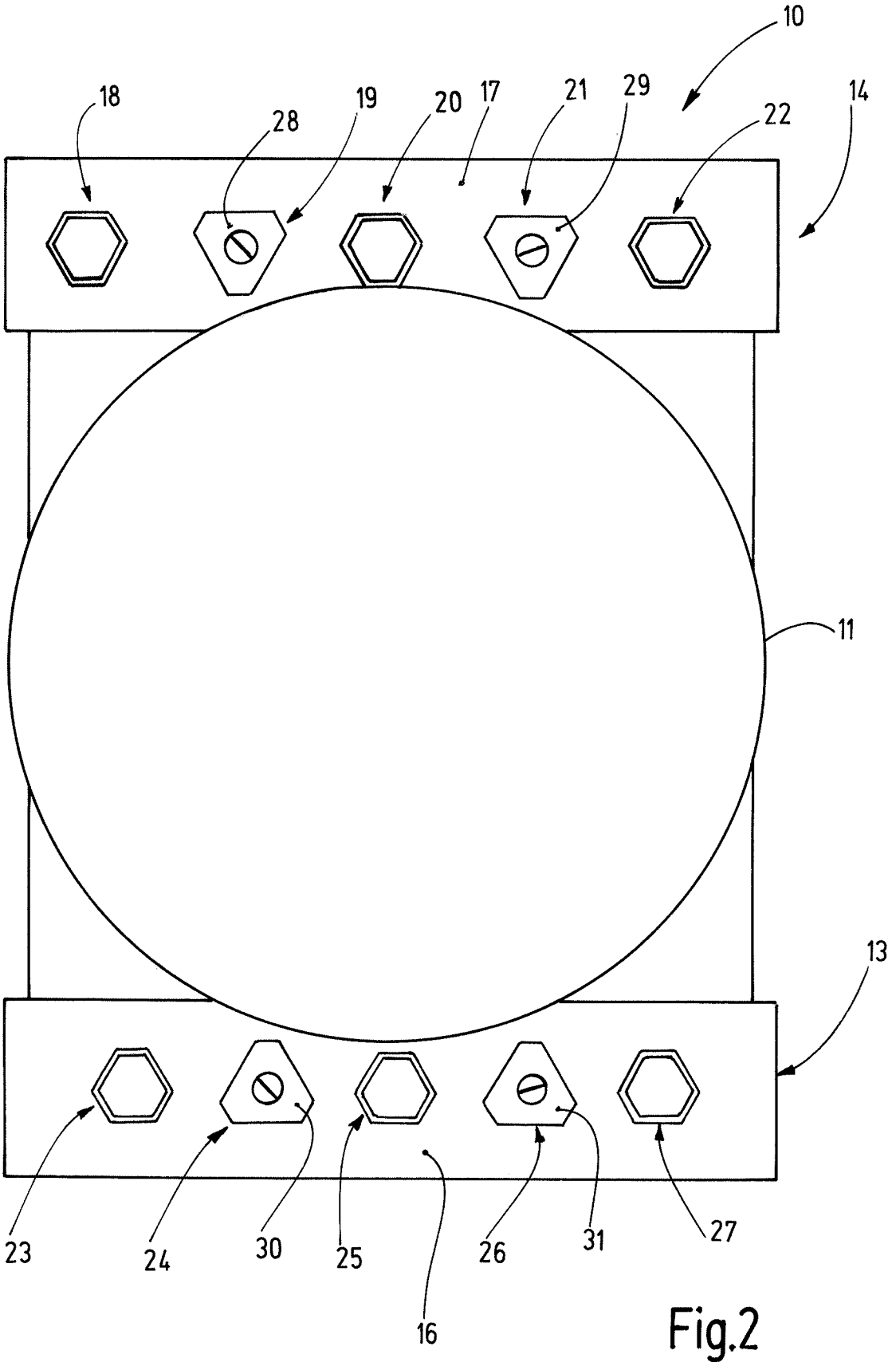
Figures 3, 4, 5:
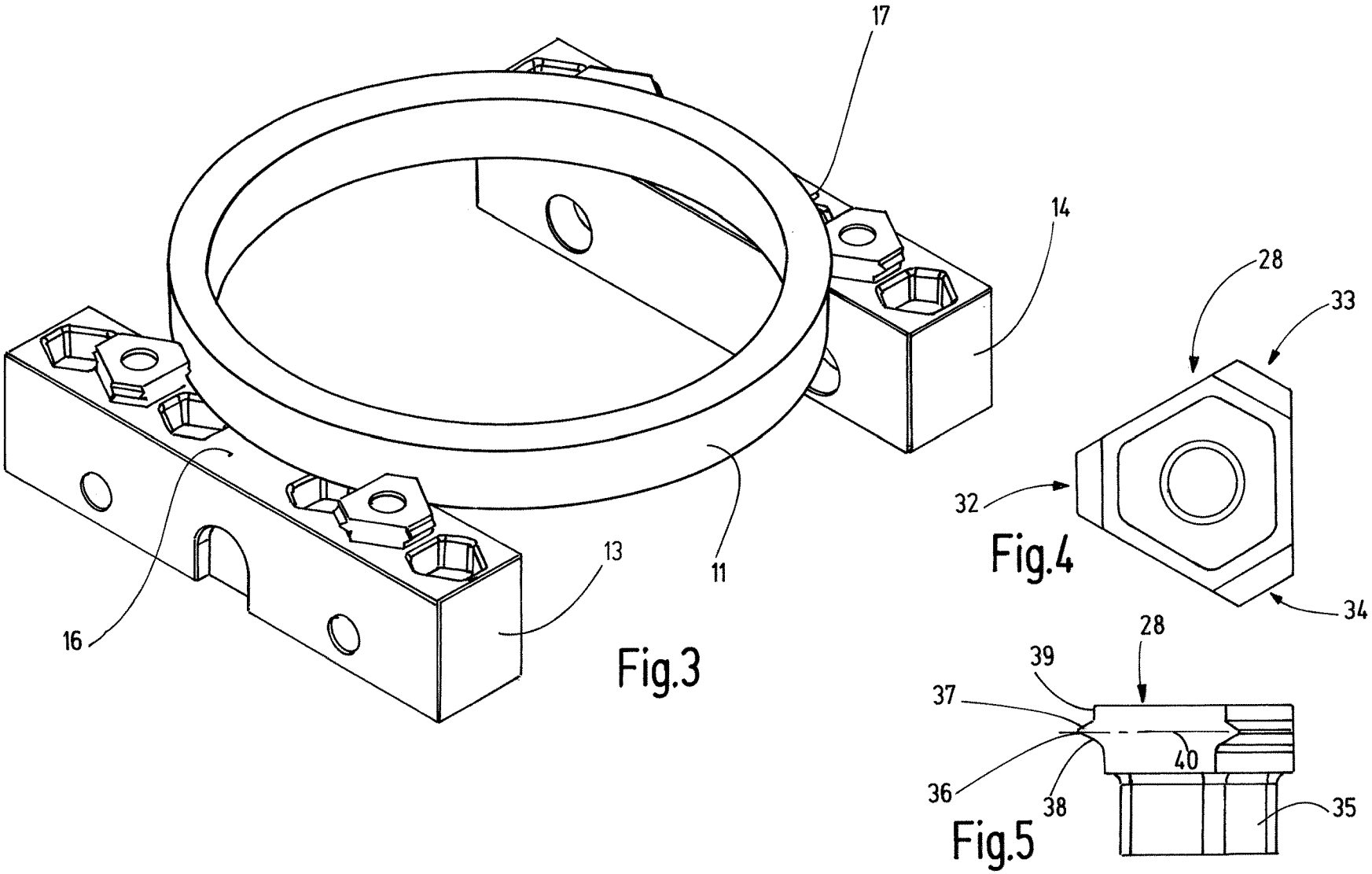

As apparent from FIGS. 2 and 3, the two jaws comprise at their top side a workpiece support surface 16, 17 respectively that are preferably arranged in a common plane. The jaw 14 comprises at least one, preferably multiple seats 18 to 22 that can be configured, for example, as polygonally surrounded pockets. Also the jaw 13 comprises multiple seats 23 to 27 that are preferably configured as polygonally surrounded pockets that preferably correspond in shape and dimension with the seats 18 to 22. In at least one and preferably multiple of the seats 18 to 22; 23 to 27 of the two jaws 13, 14 insertion bodies 28, 29, 30, 31 are mounted and secured with a suitable fastening means, e.g. a screw, respectively. Thereby the insertion bodies 28 to 31 serve as embossing teeth or also as counter support for the respective opposed embossing tooth.

The insertion bodies 28 to 31 are also identically configured, just like the seats 18 to 27. The insertion body 28 illustrated in FIGS. 4 and 5 and its following description are thus representative for all of the used insertion for all of the insertion bodies 28 to 31 used in the embossing device 10.

The insertion body 28 comprises with view from the top a, for example, hexagonal scalene, however three times rotationally symmetric circumference. Bar-like projections 32 to 34 are formed on the three shorter edges of this hexagonal circumference that extend radially outward and form embossing teeth.

According to FIG. 5, below its hexagonal head the insertion body 28 comprises a polygonal, e.g. hexagonal, pole 35 that can also have a hexagonal circumference and fits with minor clearance in the seats 18 to 27. Preferably the hexagonal pole 35 comprises a scalene circumference having a triple rotational symmetry. In other words the pole 35 can be inserted in the respective pocket 19 in three positions that are respectively rotated about 120° relative to each other.

The bar-like projection 32 is identical with the bar-like projections 33, 34 and preferably comprises a wedge-shaped cross-section, as shown in FIG. 5, according to which two wedge surfaces 37, 38 adjoin the penetration edge 36. The penetration edge 36 is orientated in circumferential direction relative to the workpiece 11 and also relative to the insertion body 28 respectively. The rounding radius of the penetration edge 36 is preferably larger than zero, however in turn preferably smaller than one tenths of the length of the wedge surface 37 measured from the penetration edge 36 up to the adjoining workpiece contact surface 39. The wedge angle defined by the wedge surfaces 37, 38 comprises an angle bisector arranged in a plane 40 that comprises all penetration edges 36 of all bar-like projections 32 to 34 and is preferably orientated parallel to the workpiece support surface 17.

The wedge surface 38 transitions in a lateral surface of the insertion body 28 that is offset backward relative to the workpiece contact surface 39.

The insertion body 28 can consist of powder steel, a hard metal, ceramic or another hard material.

The embossing device 10 described so far operates as follows:

In preparation of the subsequent clamping of the workpiece 11 it is inserted in the embossing device 10. Therefore, the jaws 13, 14 are first moved away from one another by means of the operation device 15 so far that the workpiece 11 can be placed on the workpiece support surfaces 16, 17 without getting in contact with the insertion bodies 28 to 31, as illustrated in FIGS. 1 and 2. In the next step the operation device 15 is activated such that the jaws 13, 14 are moved toward each other, e.g. in that the movable jaw 14 is moved toward the immovable jaw 13. In doing so, the workpiece 11 gets into contact with the bar-like projections 32 (i.e. the embossing teeth) of the individual insertion bodies 28 to 31 and centers automatically therebetween such that all four insertion bodies 28 to 31 abut against the lower zone 12 of the circumferential surface of the workpiece 11 with their bar-like projections 32. Thereafter the bar-like projections 32 penetrate during continuous increase of the penetration force into the workpiece 11 until the penetration force increases abruptly, due to the contact between the workpiece contact surface 39 and the workpiece 11. With this process a uniform embossing depth is achieved independent from the material characteristic and the geometric characteristics of the workpiece 11, e.g. its spring characteristics. In this case the operation device 15 is configured such that the operating force is monitored during embossing and the operation device 15 is switched off and moves the jaws 13, 14 again away from each other in order to release the workpiece, if a threshold of the operating force or a threshold of the operating force change is exceeded.

Figure 6:
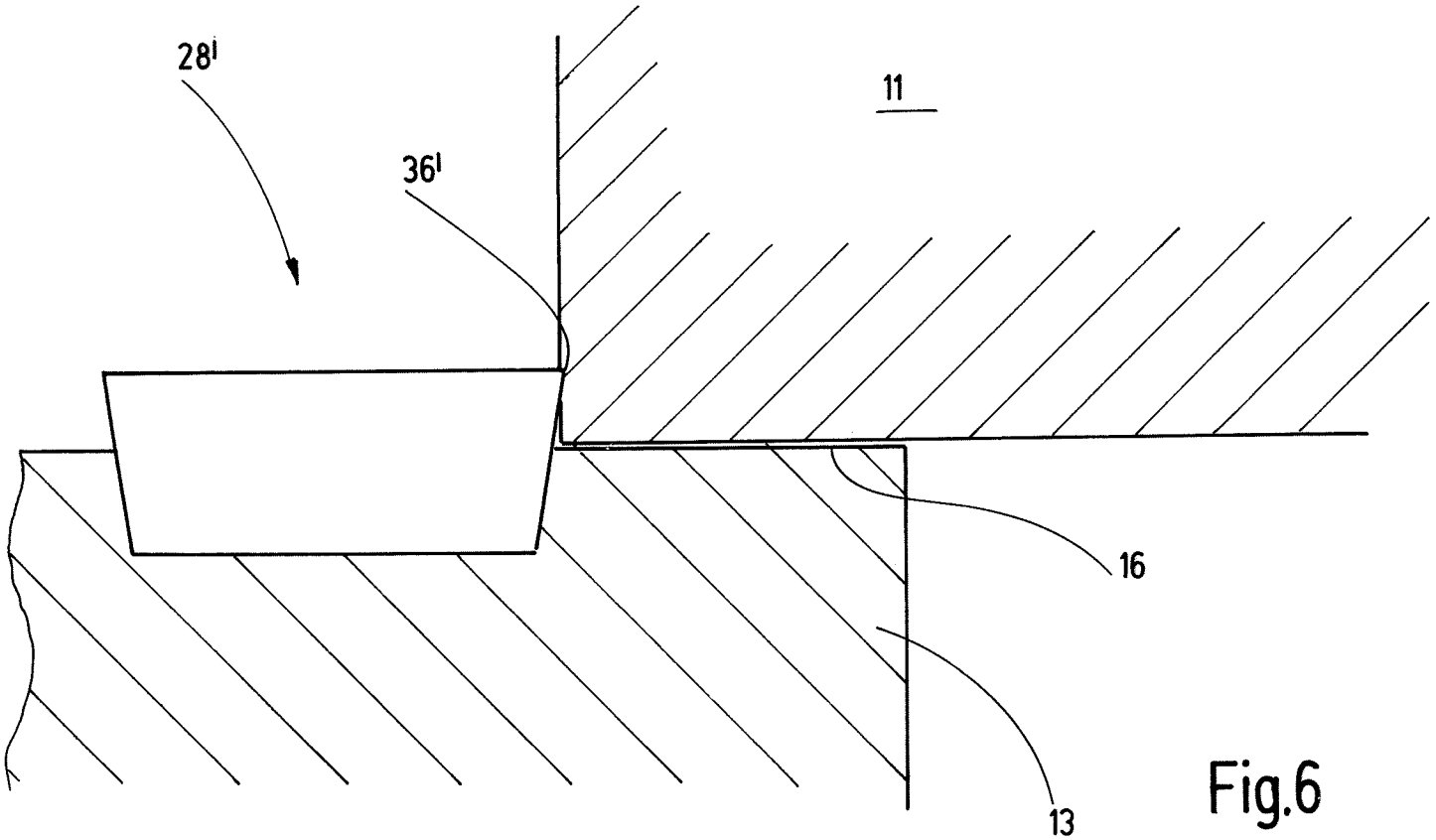
Figure 7:
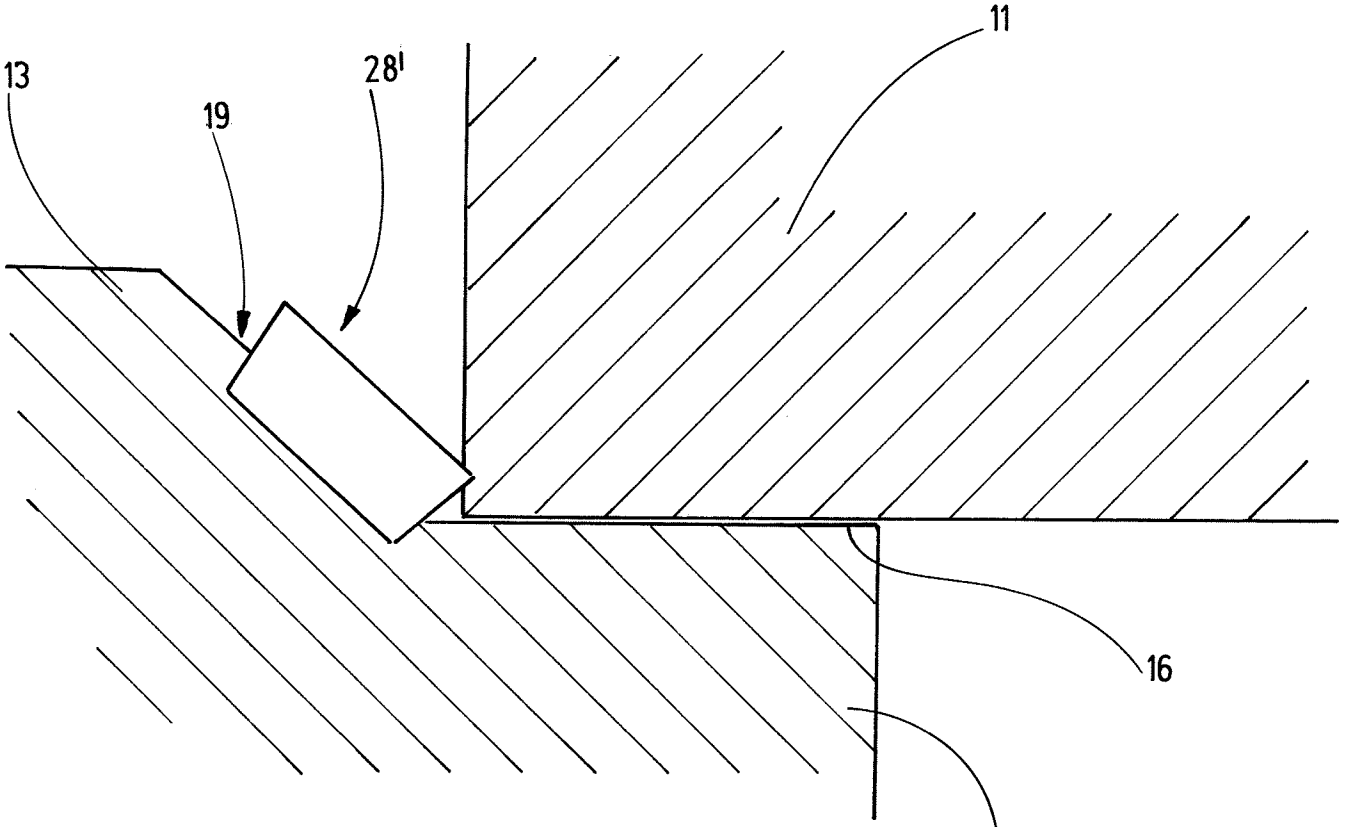

The invention was explained above based on insertion bodies 28 to 31 specifically configured for the embossing process. It is, however, also possible to use other elements instead of the specifically formed insertion bodies 28, e.g. hard metal bodies as they are in use as indexable cutting inserts as insertion bodies 28'. An example for this is shown in FIG. 6 in which the cutting edge of the indexable cutting insert, that is used as embossing tooth, is used as penetration edge 36'.

It is also possible to support the insertion body 28' on a surface or a seat 19 that is inclined relative to the workpiece support surface 16 in order to create a depression also with a standard component, such as for example an indexable insert, in use as insertion body 28' that is symmetrically with reference to a horizontal plane (plane that is parallel to the workpiece support surface 16).

An inventive embossing device 10 is provided for preparation of a mixed form-fit and friction-fit clamping of workpieces 11 in a respective clamping chuck. The embossing device 10 comprises jaws 13, 14 with embossing teeth that are formed on insertion bodies 28 to 31. The insertion bodies 28 comprise a penetration edge 36 respectively with which they penetrate into the workpiece surface in order to create a depression with defined dimensions. For this a workpiece contact surface 39 is formed on the insertion body 28, preferably in proximity to the bar-like projection 32 that stops the penetration process of the bar-like projection as soon as the workpiece contact surface 39 gets in contact with the workpiece surface during the execution of the embossing process. If the workpiece contact surface 39 abuts against the workpiece 11, the force required for moving the jaw 14 increases considerably from which a control device generates a switch-off signal for the operation device 15.

Such a control or feedback control of the embossing process allows to prepare workpieces 11 having different geometries and consist of different materials in an embossing process for subsequent clamping without the requirement to readjust the embossing device 10 depending on the respective geometry or the respective material of the workpiece 11.

LIST OF REFERENCE SIGNS

10 embossing device
11 workpiece
12 lower zone of circumferential surface
13, 14 jaws
15 operation device
16, 17 workpiece support surface
18-22 seat of jaw 14
23-27 seat of jaw 13
28-31 insertion body
28' insertion body
32-34 bar-like projections
35 pole
36 penetration edge
36' penetration edge
37, 38 wedge surfaces
39 workpiece contact surface
40 plane

The invention claimed is:

1. A method of preparing and subsequently clamping of workpieces, comprising:

inserting and fastening at least one insertion body in at least one seat, wherein the at least one seat is provided in at least one jaw;

positioning a workpiece between the at least one insertion body and a counter support;

adjusting a distance between the at least one jaw and the counter support until the at least one insertion body contacts the workpiece at least one location;

further adjusting the distance between the at least one jaw and the counter support until the at least one insertion body has penetrated into the workpiece by a desired extent to form depressions in the workpiece, the depressions being formed in the workpiece after the at least one insertion body has penetrated into the workpiece by a desired extent and has thus created the depressions in the workpiece via a local plastic deformation of the workpiece; and after the depressions have been formed in the workpiece, clamping the workpiece in a clamping device by clamping jaws configured to match the depressions formed in the workpiece, wherein the clamping device is a rotating chuck in order to carry out further machining processes.

2. The method according to claim 1, wherein the at least one insertion body contacts the workpiece with an edge or with a corner.

3. The method according to claim 1, wherein the at least one jaw is moved in a force-limited or force-change-limited manner.

4. An embossing device for providing plastic deformations on a workpiece, comprising:

a first jaw having a workpiece support surface located on an upper surface of the first jaw, the first jaw having a seat for holding an insertion body that is arranged on the seat and fastened thereon, the seat being completely surrounded by the workpiece support surface;

a second jaw having a workpiece support surface located on an upper surface of the second jaw, the second jaw being a counter support opposed to the insertion body, wherein the seat of the first jaw has a polygonal pocket configured to receive a corresponding polygonal shaft of the insertion body so that the insertion body can be used in different index positions; and an operation device that is configured to move one of the first jaw and the second jaw toward and away from the other one of the first jaw and the second jaw.

5. The embossing device according to claim 4, wherein the polygonal pocket is a plurality of polygonal pockets and the insertion body is a plurality of insertion bodies, the plurality of polygonal pockets configured to receive a corresponding polygonal shaft of the plurality of insertion bodies so that the plurality of insertion bodies can be used in different index positions.

6. The embossing device according to claim 4, wherein the counter support comprises one or more insertion bodies.

7. The embossing device according to claim 4, wherein the insertion body comprises bar-like projections that are arranged as an embossing structure for engaging the workpiece.

8. The embossing device according to claim 4, wherein the insertion body is a hard material body or a powder steel body.

9. The device according to claim 4, wherein the insertion body comprises a bar-like projection that extends along a lateral surface of the insertion body.

10. The embossing device according to claim 9, wherein bar-like projection extends parallel to the workpiece support surface of either the first jaw or the second jaw.

11. The embossing device according to claim 9, wherein the bar-like projection has a triangular cross-section.

12. The embossing device according to claim 9, wherein the bar-like projection is straight.

13. The embossing device according to claim 9, wherein the bar-like projection adjoins a surface that is configured as a workpiece contact surface.

14. The embossing device according to claim 4, wherein the counter support comprises one or more insertion bodies.

15. The embossing device according to claim 14, wherein the insertion body and the one or more insertion bodies comprise bar-like projections that are arranged as an embossing structure for engaging the workpiece.

16. The embossing device according to claim 15, wherein the insertion body and the one or more insertion bodies are a hard material body or a powder steel body.

17. The embossing device according to claim 16, wherein the bar-like projections extend along a lateral surface of the insertion body and the one or more insertion bodies.

18. The embossing device according to claim 4, wherein the polygonal pocket of the first jaw is a first plurality of polygonal pockets and the insertion body is a first plurality of insertion bodies the first plurality of polygonal pockets configured to receive a corresponding polygonal shaft of the first plurality of insertion bodies, and the second jaw comprises a second plurality of polygonal pockets for holding a second plurality of insertion bodies that are arranged in the second plurality of polygonal pockets and fastened to the second jaw the second plurality of polygonal pockets configured to receive a corresponding polygonal shaft of the second plurality of insertion bodies so that the first plurality of insertion bodies and the second plurality of insertion bodies can be used in different index positions.

19. The embossing device according to claim 18, wherein the first plurality of insertion bodies and the second plurality of insertion bodies comprise bar-like projections that are arranged as an embossing structure for engaging the workpiece and wherein the bar-like projections of the first plurality of insertion bodies and the second plurality of insertion bodies extend along a lateral surface of the first plurality of insertion bodies and the second plurality of insertion bodies.

* * * * *